United States Patent [19]

Day

[11] 4,394,806

[45] Jul. 26, 1983

[54] MULTIPLE PANE INSULATING STRUCTURE HAVING MEANS FOR REMOVING MOISTURE BETWEEN FACING SURFACES THEREOF

[76] Inventor: Ralph K. Day, 307 W. Harrison Ave., Maumee, Ohio 43537

[21] Appl. No.: 185,291

[22] Filed: Sep. 8, 1980

[51] Int. Cl.[3] ..... E06B 7/12

[52] U.S. Cl. ..... 52/172; 52/304; 52/398

[58] Field of Search ..... 52/171, 172, 304, 398, 52/399

[56] References Cited

U.S. PATENT DOCUMENTS

| | | | |
|---|---|---|---|
| 2,276,112 | 3/1942 | Stoneback | 52/172 |
| 2,278,694 | 4/1942 | Firner | 52/399 |
| 2,354,341 | 7/1944 | Verhagen | 52/399 |
| 3,932,971 | 1/1976 | Day | 52/171 |
| 4,065,894 | 1/1978 | Day | 52/171 |

FOREIGN PATENT DOCUMENTS

| | | | |
|---|---|---|---|
| 1054210 | 4/1959 | Fed. Rep. of Germany | 52/172 |
| 1226767 | 10/1966 | Fed. Rep. of Germany | 52/171 |
| 749170 | 5/1956 | United Kingdom | 52/172 |

*Primary Examiner*—J. Karl Bell

*Attorney, Agent, or Firm*—Wilson, Fraser, Barker & Clemens

[57] ABSTRACT

An appliance comprising a unitary, atmospheric pressure, equilization chamber and drying chamber in the form of a sealed, flexible walled container with open cell elastomeric material providing communication between the interior of the chamber and the zone between facing surfaces of adjacent panes of glass.

2 Claims, 6 Drawing Figures

MULTIPLE PANE INSULATING STRUCTURE HAVING MEANS FOR REMOVING MOISTURE BETWEEN FACING SURFACES THEREOF

BACKGROUND OF THE INVENTION

The use of double panes of glass and even triple panes of glass in order to provide insulation against the transmission of heat energy as well as noise energy is well-known. Such window constructions typically include two or more spaced apart parallel panes of glass, usually mounted in an elastomeric material such as rubber, for example. Means for compressing the rubber so as to seal the glass panes therein and to prevent air from leaking into and out of the space between the panes is also provided.

It is understood that it is necessary that the dead air space intermediate the panes of glass is effectively sealed. Not only is the insulating value of such windows dependent upon the maintenance of an adequate seal, but in addition, visibility also may depend on maintaining such seal. In the event moisture condenses on the inner surface of the glass, or a film of grease or dirt accumulates thereon, visibility will be adversely affected.

Many attempts have been made from time to time to provide a satisfactory solution to the problem. These attempts have involved the use of rubber sealing strips such as gaskets, with various means for compressing the gaskets against the panes. Experience, however, shows that such constructions do not consistently provide sufficient uniform pressure to provide an effective air-tight seal when subjected to conventional manufacturing techniques, particularly in wooden sash constructions.

The use of a conventional rubber sealing strip in the normal way, that is, without special efforts to achieve uniform compression, substantially reduces circulation between the ambient air and the space between the panes. One result is that the insulating effectiveness may reach a reasonably acceptable level. Another is that the accumulation of dirt between the panes is retarded; however, when it accumulates, the situation is just as unsatisfactory as the case of an ordinary storm window. In the event humid air enters the space between the panes, and the ambient temperature drops, condensation of moisture occurs between the panes and, since circulation between the ambient air in the space between the panes is slow, the window remains "fogged" for various substantial periods of time. Thus, in order to decrease the dirt problem, one finds that the condesation problems are quite detrimental to adequate visibility.

Various forms of factory sealed windows when maintained sealed as by fused metal or glass offer high quality insulation. Where pressure elastomeric gasket seals or flexible adhesive seals are provided, the dirt and condensation problem is minimized. However, such windows are of relatively high expense, involves high insurance costs, and are expensive and difficult to repair and replace. The fact that factory fabricated insulating windows can be purchased only in certain standard sizes also placed limitations in design, especially when curved windows are involved.

The fact that such expensive solutions have nevertheless found very substantial commercial success clearly indicates that the problem itself, that is obtaining good insulating quality without visibility impairment, is a pressing problem and a problem of great commercial importance, and one for which no obvious answer exists.

Thus, there remains a problem of providing a seal as good as presently possible only with factory fabricated insulating windows, which is at the same time inexpensive, readily adapted to any size or shape of window including curved windows, and which can be installed and repaired at the job site rather than requiring factory fabrication.

Air-type seals are well-known in the technicology, but the problem in connection with the insulating windows is to obtain a seal which is not only effective, but also extremely simple in design and installation and low in cost. Complicated constructions make excellent air-type seals for scientific and industrial apparatus, but have no place in construction of residential, commercial, and industrial buildings, or in vehicles such as automobiles, buses, trains, and air craft.

The difficulties which must be overcome in the solution of this problem include the following:

1. Considerable force must be necessary to make a tight seal, but glass panes must not be broken nor stressed so that the glass panes would break upon temperature and atmospheric pressure changes or additional stress.

2. It is not sufficient to provide an excessively large force at some points and inadequate force elsewhere. "Averages" are not what counts here, but rather uniform seal around the peripheral facing edges of the adjacent surfaces of the associated glass panes.

3. Expansions and contractions caused by temperature variations with seasonal variations, or with changes in elevation, for example during shipment, must be accounted for without causing breakage on one hand and/or air leakage on the other.

Heretofore pressure variations between the gas within the space between the facing surfaces of double glazed window construction and the atmosphere as caused by temperature changes or changes in atmospheric pressure have been compensated to reduce the pressure differential across the seals between the adjacent panes by providing an auxilliary chamber containing a fixed amount of gas which is at the pressure within the space and is varied in volume to match or approach atmospheric pressure U.S. Pat. No. 1,852,661 entitled "SHOW CASE REFRIGERATOR" to Larkin discloses syphons exterior of the double glazed window of a show case and in gas flow communication with the space between the panes of glass that expand and contract to compensate for difference in pressure between the interior and exterior of the space. U.S. Pat. No. 2,015,808 entitled "DOUBLE WINDOW CONSTRUCTION" Miller et al. discloses a frame including a cavity containing a tube of thin metal or rubber which may be collapsed and expanded when varying air pressures are applied to the unit. The prior art has also attempted to eliminate the problem of fogging between adjacent panes of glass of a hermatically sealed window or transparent panel which is double glazed by introducing dry gas into the space between the panes and/or by including a desiccant in a container in gas communication with the space. U.S. Pat. No. 1,913,205 entitled "ANTI-FOGGING DEVICE" Lenhart shows a tray of desiccant screened from in gas flow communication with the space between the panes of a double glazed window. Alternatively, a number of patents disclosed valves providing admission of gas to the space between lights of double glazed windows and suggest the temporary connection of sources of dry gas for drying and flushing such space. These U.S. Pat. Nos. include the following: 1,495,948—Carney, 1,851,515— Hunt et al., 2,009,142—Marsh, 2,117,581—Stoneback, 2,756,467—Etling, 2,880,475—Mills.

Leaks in the units of the prior art having gas drying arrangements have resulted in the admission of sufficient moisture to cause the drying capabilities of the desiccant in those units containing desiccant and ultimate fogging of the interior of the window. These leaks have been attributed to pressure differentials between the interior and exterior. In U.S. Pat. No. 2,083,622 Summers discloses the concept of a pressure equilization mechanism combined with a drying mechanism for a double walled panel which in some embodiments is of transparent materials. The combination of the Summers is cumbersome and does not lend itself to application to conventional window construction. Further, if some leakage of moisture into the system does occur, the desiccant can be exhausted with resultant failure of the system.

A replaceable desiccant supply has been proposed for double glazed windows, such as for example, U.S. Pat. No. 2,088,738 entitled "DOUBLE GLAZED WINDOW" Fox wherein there is disclosed a detachable casing containing a desiccant which is screw coupled in a cavity in the face of the window frame in gas flow communication with the space between the transparent panes so that it can be replaced when the desiccant is spent. However, this casing protrudes from the window frame and offers an unsightly obstruction. Further, it is a dead end to the gas conduit from the window enclosure and with no circulating means and therefore offers only limited access to the gas within the enclosure.

U.S. Pat. No. 3,685,239 entitled "HERMATICALLY SEALED DOUBLE GLAZED WINDOW UNIT AND METHOD OF SEALING SAME" McCurdy et al. discloses a rechargeable desiccant chamber in the wall of a window frame wherein a lower port can be opened to withdraw spent granular desiccant and an upper port through which a new charge of desiccant can be introduced.

In a previously granted U.S. Pat. No. 4,065,894 entitled "REPLACEABLE DOUBLE GLAZED WINDOW DEFOGGING APPLIANCE AND WINDOW STRUCTURE THEREFORE", it was explained that certain of the shortcomings of the prior art could be overcome by utilizing a unitary, atmospheric pressure equalization chamber and drying chamber including a sealed flexible walled container having means providing communication from its interior to the space between a double-glazed window structure. The communication means, although operatively satisfactory, were somewhat complex and required the associated window frame to be particularly configured to accept the communication means which were typically in the form of a hollow tube or duct.

SUMMARY OF THE INVENTION

The present invention has similar objectives in purpose as the prior art, but is able to achieve the objectives with a less complicated structure. While the structure is less complicated, it is also more efficient, and surprisingly less expensive than the devices heretofore available.

In a preferred embodiment, the present invention contemplates a combination of a pair of substantially parallel spaced apart panes of transparent sheet material; resilient gasket means disposed between the marginal edges of the facing surfaces of said panes, said gasket means including elongate strips of material impervious to the flow of air therethrough and at least one strip of a material pervious to the flow of air therethrough, said gasket means having compressible faces engaging the adjacent faces of said spaced apart panes and defining an enclosed volume between the facing surfaces of said panes; a frame circumscribing the periphery of said panes, said frame including elements having grooves for receiving the marginal edge of said panes to urge said panes toward one another to compress said gasket means an amount sufficient to produce an air-tight sealing contact between the marginal edges of the facing surfaces of said panes and said gasket means, at least one of said frame elements having a receptacle formed therein; the strip of material pervious to the flow of air therethrough of said gasket means in registry with the receptacle in said frame element; and a sealed container having flexible walls fitted within the receptacle of said frame element and carrying a quantity of dehydrating material communicating with said air pervious material of said gasket means; and vent means providing communication between ambient atmosphere and the receptacle of said frame elements for pumping gas between said container and the enclosed volume between the facing surfaces of said panes.

It is an object of the invention to improve multi-glazed window structures.

Another object of the invention is to overcome fogging due to entrapped moisture formed within the interior of multi-glazed window construction.

Another object of the invention is to enable unskilled persons to replenish the desiccant charge in multi-glazed window constructions.

Still another object of the invention is to enhance the circulation of atmosphere between panes of a multi-glazed window construction into a chamber containing a suitable desiccant.

Still another object of the invention is to enable the gasket material pervious to the flow of air therethrough and the associated desiccant containing flexible walled container to be independently produced, marketed, and available for installation in existing multi-glazed window constructions.

And yet another object of the invention is to improve the appearance and reduce the complexity, original cost, and maintenance cost of multi-glazed window constructions having means for removing moisture between the panes of the structure and for compensating pressure differentials between the space between the panes and the ambient atmosphere.

BRIEF DESCRIPTION OF THE DRAWINGS

The above, as well as other objects and advantages of the invention, will become readily apparent to one skilled in the art from reading the detailed description of the an embodiment of the invention when considered in the light of the accompanying drawings, in which.

DETAILED DESCRIPTION OF THE PREFERRED EMBODIMENT

Figure 1:
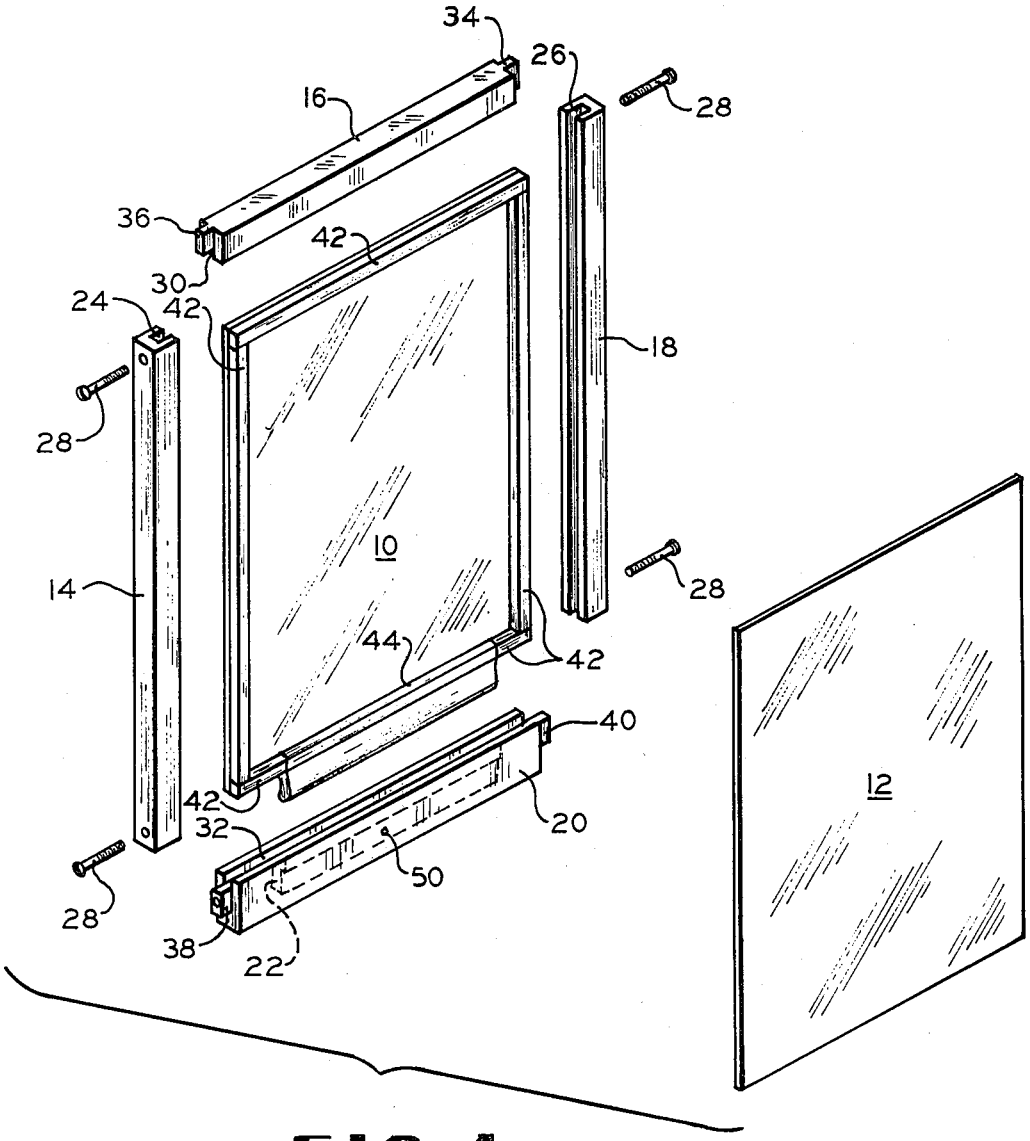
FIG. 1 is an exploded perspective view of a double-glazed window construction embodying the features of the present invention.

Referring to FIG. 1, there is shown a window construction preparatory to the final assembly thereof, which includes a pair of panes of glass 10 and 12 which typically are of substantially identical dimension. The frame of the window of FIG. 1 includes frame elements 14, 16, 18, and 20 preferably formed of a material having low thermal conductivity such as wood, for example. The frame elements 14 and 18 are substantially identical with one another. The bottom frame element 20 is typically of a deeper dimension than the top element 16 and contains a receptacle or cavity 22 which opens upwardly as will be explained in greater detail hereinafter. The vertically disposed frame elements 14 and 18 are provided with longitudinally extending grooves 24 and 26, respectively, Threaded fastener receiving holes are suitably formed in the frame elements 14 and 18, at respective ends thereof, to receive suitable threaded fastener means such as wood screws 28, for example.

The horizontally disposed frame elements 16 and 20 are provided with longitudinally extending grooves 30 and 32, respectively. Extending outwardly from opposite ends of the frame element 16 are tongues 34 and 36 which, in the assembled form of the window construction, fit within the grooves 24 and 26 of the frame elements 14 and 18, respectively. The frame element 20 also has outwardly extending tongues 38 and 40 which fit within the grooves 24 and 26 of the frame elements 14 and 18, respectively, and have holes formed therein which are adapted to receive the wood screws 28 when the frame is assembled.

An elongate strip or strips of an elastic material being contoured to form an air tight contact along the marginal edge portions of the facing surfaces of the glass panes 10 and 12 is disposed around the panes 10 and 12 prior to final assembly of the window construction. The elongate gasket strip of elastic material is typically formed of a strip or strips 42 of elastomeric material which is typically impervious to the passage of air therethrough, such as for example a closed cell sponge rubber or Neoprene. This material is disposed to extend about the upper horizontal marginal edge of the associated glass panes 10 and 12, and also the vertical marginal edges, as well as a portion of the lower marginal edges. The gasket strip 44 which is adapted to extend between the free edges of the gasket strip 42 at the lower horizontal edges of the glass panes 10 and 12 is formed of an elastomeric material such as an open cell sponge rubber or Neoprene which is typically pervious to the flow of air therethrough. It will be understood that the gasket strip 42 may be a continuous strip of closed cell material having the outer portion severed to facilitate the 90° turn to accomodate the particular configuration of the associated panes 10 and 12. However, in the preferred embodiment the gasket strip 42 is formed of five discrete lengths of strip material.

Figure 3:
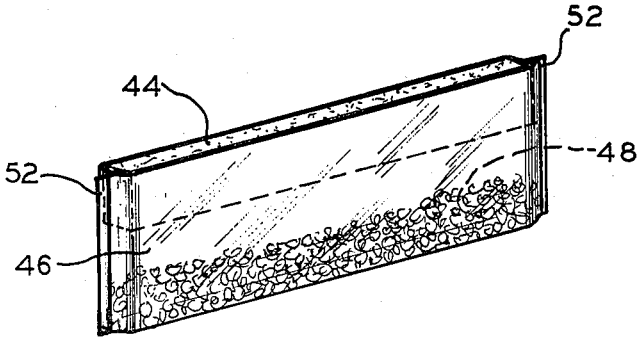
FIG. 3 is a perspective view of a replaceable section or strip of gasket material pervious to the flow of air therethrough and the associated flexible walled container for containing the desiccant material.

Next, the desiccant containing element illustrated in FIG. 3 is disposed along the lower marginal edges of the panes 10 and 12 between the free ends of the gasket strip 42. The desiccant containing element of FIG. 3 includes the gasket strip 44 formed of the opened cell elastomeric material, a flexible walled container 46 formed of a material which is typically plastic sheet material and impervious to the flow of air therethrough, and a charge of desiccant 48.

In assembling the window construction, after the gasket strips 42 and 44 are placed against the marginal edges of one surface of the glass pane 10, the second glass pane 12 is then layed in juxtaposed position thereon, and the panes 10 and 12 are pressed towards each other. At this point, the frame elements 14, 16, 18 and 20 are slipped onto and secured to each other by the threaded fasteners 28. It will be noted that the dimensions of the grooves 24, 26, 30, and 32 of the frame elements 14, 16, 18, and 20, respectively are such as to cause the elastomeric material of the strips 42 and 44 to be in compression in the assembled form.

It will be appreciated that during the above noted assembly procedure that the flexible walled container 46 containing the desiccant material 48 is caused to be received within the enlarged cavity or receptacle 22 in the frame element 20.

When the elements of the assembly are positioned as described above, the threaded fasteners 28 are inserted in the frame elements 14 and 18 and are tightened to draw the tongues 34 and 36, and 38 and 40, of the frame elements 16 and 20, respectively snuggly within the grooves formed in the associated frame elements 14 and 18. After the threaded fasteners 28 are tightly secured, the window construction is completed. It will be appreciated that since the elastomeric material of the gasket strips 42 and 44 are maintained in a state of compression, an air-tight seal is formed between the opposing walls of the strip and the adjacent interfacing surfaces of the marginal edges of the glass pane 10 and 12.

It will further be appreciated that in the event it is ever necessary to disassemble the window construction to clean the interior surfaces of the glass panes 10 and 12, it is necessary only to loosen the four threaded fasteners 28 and pull the frame elements 14, 16, 18, and 20 apart.

Thus, it will be appreciated if the assembled window construction is provided with a pressure equilization and moisture removing or drying mechanism mounted within the receptacle or cavity 22. More specifically the interior of the flexible walled container 46 containing the desiccant 48 is in communication with the space between the glass panes 10 and 12 through the opened cell structure of the gasket strip 44. This arrangement tends to eliminate pressure differentials between the interior space and the ambient atmosphere by the expansion and contraction of the walls of the flexible walled container 46 and further militates against the admission of ambient temperatures into the space between the panes of glass. However, in the event there is any leakage, the transfer of gas between the space intermediate panes 10 and 12 and the interior of the flexible wall container 46 with changes in atmospheric pressure and temperature tends to circulate the gas over the desiccant 48 to remove moisture therefrom and prevent fogging within the interior space. It will be observed that ambient atmospheric pressure is provided access to the receptacle or cavity 22 and thus to the exterior of the flexible walled container 46 by a suitably positioned vent means 50 formed within the wall of the framed element 20.

Figure 2:
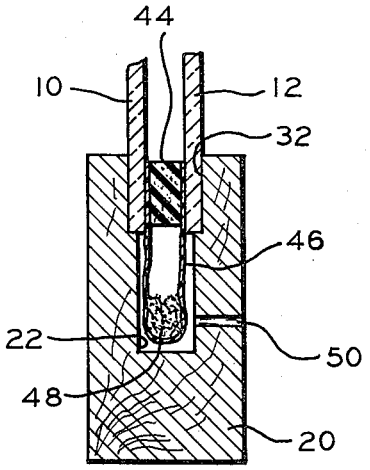
FIG. 2 is an enlarged fragmentary sectional view of that portion of the window frame containing the receptacle and illustrating the flexible walled container for the desiccant material and the associated gasket material pervious to the flow of air therethrough as illustrated in FIG. 1.

Since it is understood that the gasket strip 44, the flexible walled container 46, and the desiccant are expendable, it will be appreciated that these elements may be readily removed from the window construction as illustrated in FIGS. 1 and 2 and a replacement desiccant containing element may be readily inserted. While the specific type of desiccant utilized in this invention is not regarded as being critical, it has been found that a desiccant in granular form, such as W. R. Grace No. 801 desiccant has exhibited satisfactory results.

Figure 4:
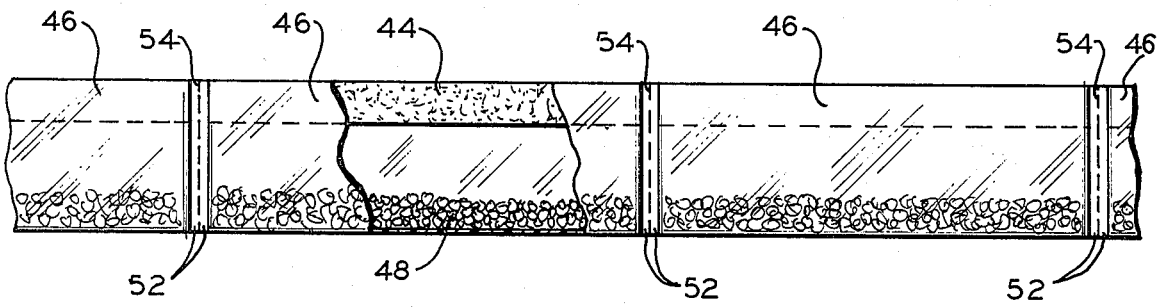
FIG. 4 is a fragmentary view of a continuous strip of the replacement units prior to being severed as illustrated in FIG. 3.

As illustrated in FIG. 4, the gasket strip 44 formed of the air pervious elastomeric material, the flexible walled plastic container 46, and the associated granular desiccant 48 may be commercially produced as a continuous strip of individual replacement elements separated by transversely extending heat sealed segments 52 which may be preferrably serated to form a tear line 54. These strips may be formed any desired number of separable replacement elements which may be packaged and sold to a user in any desired number of separate units; or alternatively, may be sold to a retailer who in turn could merely tear off units to be sold individually.

Figure 5:
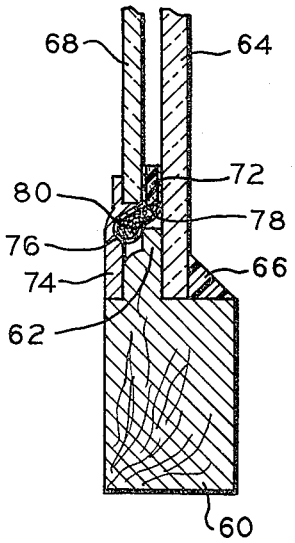
FIG. 5 is a fragmentary sectional view of a conventional window construction after being retrofitted with the desiccant containing units or element illustrated in FIG. 3.
Figure 6:
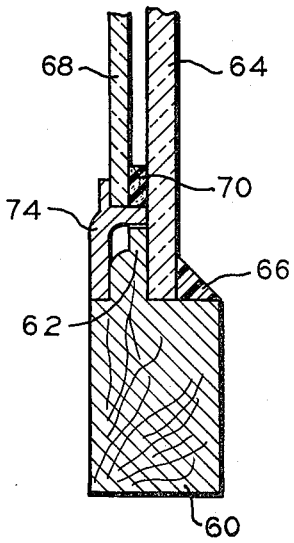
FIG. 6 is a fragmentary sectional view similar to FIG. 5 illustrating that portion of the retrofitted structure showing the placement of the gasket material between facing surfaces of adjacent panes of glass wherein the gasket material is impervious to the flow of air therethrough.

The foregoing description of the invention has been directed primarily to a double-glazed window construction specifically designed for reception of the moisture removing and pressure equilization inserts as illustrated in FIGS. 3 and 4. However, it will be appreciated that the units illustrated in FIGS. 3 and 4 may also be advantageously utilized in retrofitting conventional single glazed window structures into more energy efficient double-glazed window structures. More specifically FIG. 5 and 6 illustrate a typical single glazed window construction employing a frame member 60 having a decorative and functional inwardly extending lip portion 62 the outer surface of which presented a flat surface for receiving the inner facing marginal edge of a glass pane 64. The outer marginal edge of the glass pane 64 is adopted to receive a glazing compound 66 which forms a seal between the glass pane 64 and the frame 60. In order to retrofit the original window to receive another pane of glass 68, gasket material 70 formed of an elastic material impervious to the passage of air therethrough may be used in cooperation with an associated gasket material 72 of an elastomeric material which is pervious to the flow of air therethrough. This is much in the same fashion as illustrated in FIG. 1. That is, that the outermost inner marginal edges of the glass pane 68 are spaced from the spacing surface of the glass pane 64 for a substantial distance around the periphery of the glass pane 68, while a minor portion is separated by the elastomeric strip 72 of the material which is pervious to the flow of air. The outer marginal edges of the glass pane 68 are held in position to slightly compress the elastomeric material of the strips 70 and 72 by a supplemental frame member 74 in the manner shown in FIGS. 5 and 6. The interior portion of the supplemental frame member 74 is provided with a suitable cavity or receptacle 76 adapted to receive a flexible walled container 78 which contains the granular desiccant 80 to enable the interior space between the glass panes 64 and 68 to communicate with the desiccant 80 through the gas perious gasket strip 72.

In light of the above description of the structure illustrated in FIGS. 5 and 6, it will be readily apparent that the units illustrated in FIGS. 3 and 4 may be advantageously adopted for use in modifying a conventional single glazed window structure to a considerably more energy efficient double glazed structure with the minimum of time and expenditure of monies.

It will be understood that the invention has been illustrated and described wherein only a single one of the units illustrated in FIG. 3 are utilized. However, several units may be provided on larger window constructions, or in situations where the conditions tend to cause large amounts of moisture to be admitted between the facing surfaces of the glass pane. Further, the specific structure materials of the window units and there assembly elements and techniques may be varied.

Although I have described the preferred form of the invention, it is to be understood that changes in details of procedure and devices employed may be made without departing from the invention, especially as defined in the appended claims.

What is claimed is:

1. A multiple-glazed window structure comprising:

at least two substantially parallel and spaced apart panes having an outer periphery defined by the outer marginal edges of said panes;

an impervious gasket means disposed between the facing surfaces of said panes, said impervious gasket means extending along only a portion of the outer periphery of said panes and having spaced apart end portions defining the remaining portion of the outer periphery;

a pervious gasket means disposed between the facing surfaces of said panes and extending between the ends of said impervious gasket means along the remaining portion of the outer periphery of said panes, said pervious gasket means and said impervious gasket means cooperating to define a chamber between said panes;

an impervious flexing container positioned along the outer periphery of said panes adjacent said pervious gasket means, said container having an interior in fluid communication with said chamber through said pervious gasket means;

a desiccant within the interior of said flexible container; and frame members supporting said panes and compressing said impervious and said pervious gasket means between said panes; said impervious gasket means, said container, and said panes defining a closed zone generally impervious to the ambient atmosphere.

2. The invention defined in claim 1 wherein said impervious gasket means comprises an elongate strip of closed cell elastomeric material, said pervious gasket means comprises a short strip of open cell elastomeric material and said flexible container is formed of impervious plastic sheet material.

* * * * *